US006372035B1

(12) United States Patent
Juppo et al.

(10) Patent No.: US 6,372,035 B1
(45) Date of Patent: Apr. 16, 2002

(54) HYDROPHOBISING SYSTEM FOR PAPER OR SIMILAR FIBER PRODUCT

(75) Inventors: Ari Juppo, Vaasa (FI); Philip Håkansson, Sölvesborg (SE)

(73) Assignee: Kemira Chemicals Oy, Helsinki (FI)

( * ) Notice: Subject to any disclaimer, the term of this patent is extended or adjusted under 35 U.S.C. 154(b) by 0 days.

(21) Appl. No.: 09/601,095

(22) Filed: Jul. 25, 2000

(30) Foreign Application Priority Data

Jan. 27, 1998 (FI) ..... 980177

(51) Int. Cl.[7] ..... D21H 17/17; D21H 17/71; D21H 17/14

(52) U.S. Cl. ..... 106/287.2; 106/164.4; 162/158

(58) Field of Search ..... 106/287.2, 164.4; 162/158

(56) References Cited

U.S. PATENT DOCUMENTS 5,306,757 A * 4/1994 Hatanaka et al. ..... 524/321
6,248,164 B1 * 6/2001 Hakansson ..... 106/287.2

* cited by examiner

*Primary Examiner*—David Brunsman
(74) *Attorney, Agent, or Firm*—Greenberg Traurig, LLP; Joseph M. Manak

(57) ABSTRACT

The invention relates to a hydrophobising system for paper or a similar fiber product, comprising (1) a ketene dimer, and (2) an alkenyl and/or alkyl succinic acid and/or a salt thereof.

The invention additionally relates to a method for hydrophobising paper or a similar fiber product comprising adding a hydrophobising system defined above to fibers.

22 Claims, No Drawings

HYDROPHOBISING SYSTEM FOR PAPER OR SIMILAR FIBER PRODUCT

The application is a 371 of PCT/F199 /00051, filed Jan. 27, 1999.

The invention relates to a hydrophobising system for paper or a similar fibre product, such as cardboard, to its use, and to a method for hydrophobising paper or a similar fibre product. The invention particularly relates to the joint use of an alkyl ketene dimer (AKD) and an alkenyl succinic acid (AS acid) in the hydrophobising of paper.

When paper or cardboard is stock sized in neutral and slightly alkaline conditions, AKD and/or an alkenyl succinic anhydride (ASA) is commonly used, as disclosed in patents DE-OS 24 39 026, WO-94/13883, GB-A-2 252 984, EP-B-0 220 941, EP-B-0 228 576, and WO 97/35068. According to a general principle, it is presented that a prerequisite for the functioning of these substances is that they react with the cellulose fibres of the paper in question to make the paper hydrophobic, i.e., water repellent. It is considered necessary that the above-mentioned substances form a covalent bonding with the cellulose, which is considered to occur in the drying stage of the paper web in a paper or board machine. Since the alkenyl succinic acid cannot form a bonding in these conditions, it has not been considered possible to hydrofobise paper. AKD and ASA are dosed into the paper pulp before the head-box. Because the substances are oil-soluble and do not dissolve in water, they are emulsified into a water dispersion before dosing.

The ketene dimer which generally is an alkyl ketene dimer (AKD) or alkenyl ketene dimer, can be presented in the form of formula (I) where $R_1$ and $R_2$ are hydrocarbon groups containing from 8 to 36 carbon atoms, and which can be saturated or unsaturated or branched or straight-chained. The hydrocarbon groups normally used include molecules containing from 14 to 18 carbon atoms.

(I)

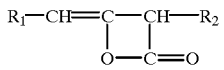

Regarding the particle size of AKD dispersions, it is generally desirable to use an average particle size of less than 1 $\mu$m; hence, they are commonly manufactured by high-pressure homogenisers in plants specialised in the manufacture of the products.

Although AKD is reactive and decomposes into a ketone in an aqueous solution, the reaction is slow at low pH (less than 4.5) in particular and, therefore, AKD dispersions can be delivered to the client as complete dispersions. Current AKD emulsions are physically stable and can be used for several weeks. The AKD dispersion is generally stabilised with starch and, possibly, jointly with it with polymers, such as polyethylene imine, polyepiamine, polydimethyl diallyl compounds or disyandiamide compounds, polyacrylamide, or polyacrylic acid. It is common knowledge that the amount of stabilisation chemicals ranges from 1% to 200% by weight of the amount of the AKD. The use of polymers does not only improve the stability of the product but they also have an effect on the functioning of the product in paper or cardboard.

The alkenyl succinic anhydride (ASA) and the alkyl succinic anhydride can be described in the form of formula (II). Groups $R_3$ and $R_4$ are hydrocarbon chains, the total length of which is suitably from 7 to 23 carbon atoms. The alkenyl carbon chain of commercial ASA products is branched or unbranched. ASA can be manufactured of so-called terminal olefins in which the double bond is between carbons 1 and 2 of the carbon chain of the olefin, so that the length of the carbon chain of $R_3$ is from 6 to 22, and $R_4$ is —$CH_3$ or —H. In that case, the ASA is called "terminal ASA". When a so-called internal olefin is used as raw material, in which the double bond is randomly situated in the olefin chain, the ASA is called "internal ASA".

(II)

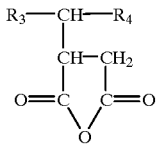

ASA which is reactive and decomposes 90% in an aqueous solution in one day, is, therefore, delivered to the client without water. ASA is dispersed at the paper mill or board mill by using an equipment installed for this purpose. The manufactured dispersion is immediately fed to a paper or cardboard machine. To facilitate the manufacture of the ASA dispersion, a surfactant is generally added to the product, such as dioctyl sulpho-succinate, octyl phenoxy polyethoxyl ethanol, polyethylene oxide nonyl phenyl phosphate or polyethylene oxisorbitane trioleate. Generally, substances that stabilise the dispersions of liquid ASA can include, at the manufacturing stage, starch or other polymers, such as water-soluble cellulose derivatives, for example, hydroxy ethyl cellulose, hydroxy propyl cellulose, methyl hydroxy propyl cellulose, ethyl hydroxy ethyl cellulose, carboxy methyl cellulose, or gelatine, guar gum, xanthan gum, polyvinyl alcohol, etc. The drop size of the dispersion is generally from 0.2 to 3 $\mu$m, on the average. Agents that intensify sizing commonly include highly cationic split starch having a charge of from 1 to 2 meq/g, and a viscosity as a 30% aqueous solution of 2500–5000 mPas, chitosan, cationic polymers, such as polyethylene imine, polyepiamine, polyvinylamine, polydimethyl diallyl compounds or dicyandiamide compounds or polyacrylamide or anionic polyacrylic acid or their salts or aluminium compounds, such as polyaluminium chloride, polyaluminium sulphate, and polyaluminium nitrate or alum, which can be included in the product or separately dosed into the pulp.

According to the invention, it has been unexpectedly discovered that AS acid, the hydrolysis product of ASA, and its salt can be used to intensify the sizing of AKD.

Consequently, according to the invention, a hydrophobising system for paper or a similar fibre product is provided, comprising (1) a ketene dimer, and (2) an alkenyl and/or alkyl succinic acid and/or a salt thereof.

The ketene dimer is preferably an alkyl ketene dimer (AKD) or alkenyl ketene dimer, the ketene dimers having the formula (I) described above. The ketene dimer is specifically preferably AKD.

The alkenyl and alkyl succinic acid of the hydrophobising system according to the invention can be described by the formula (III)

(III)

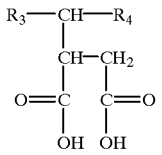

in which $R_3$ and $R_4$ are as defined above.

The acid of formula (III) can be manufactured from a corresponding anhydride of formula (II), in a way known per se by using water treatment, for example, by heating the anhydride together with an excess amount of water at 50° C. for one day or at 80° C. for one hour vigorously agitating it at the same time.

In the following, the acid of formula (III) is called AS acid. This AS acid is preferably an alkenyl succinic acid.

The AS acid can be manufactured from a so-called terminal anhydride of formula (II), which hereinafter will be called "terminal AS acid". As raw material, a so-called internal anhydride of formula (II) can also be used, the corresponding AS acid being hereinafter called "internal AS acid".

In the acid of formula (III), the sum of the carbon atoms of the alkenyl or alkyl groups is preferably 7–23.

In the hydrophobising system according to the invention, the proportion of the ingredient (2) as calculated as an amount of acid is preferably 5–50% by weight of the amount of the ingredient (1), and especially preferably 10–30% by weight of the amount of the ingredient (1).

In the hydrophobising system according to the invention, ingredients (1) and (2) can be in the form of a mixture, preferably in the form of an aqueous dispersion.

In the hydrophobising system according to the invention, ingredients (1) and (2) can also be present as separate formulations, the formulations being preferably aqueous dispersions.

The hydrophobising system according to the invention, when in the form of an aqueous dispersion, can also contain a stabilising agent selected from the group: starch, cellulose-based polymers, such as hydroxy ethyl cellulose, hydroxy propyl cellulose, methyl hydroxy propyl cellulose, ethyl hydroxy ethyl cellulose or carboxy methyl cellulose, gelatine, guar gum, xanthan gum or polyvinyl alcohol.

The hydrophobising system according to the invention can also contain an agent that intensifies the sizing, which is selected from the group: cationic split starch, chitosan, polymers, such as polyethylene imine, polyepiamine, polyvinyl amine, polydimethyl diallyl compounds or dicyandiamide compounds or polyacrylamide or polyacrylic acid or their salts, or aluminium compounds, such as polyaluminium chloride, polyaluminium sulphate or polyaluminium nitrate or alum.

The invention also relates to the use of the hydrophobising system described above to hydrofobise paper or a corresponding fibre product, such as cardboard.

The invention further relates to a method for hydrophobising paper or a corresponding fibre product, such as cardboard, in which method a hydrophobising system described above is added to the fibres.

According to the invention, ingredients (1) and (2) can be added simultaneously. According to the invention, ingredients (1) and (2) can also be added separately.

The total sum of ingredients (1) and (2) which are added to the fibres is preferably 0.01–0.6% by weight of the amount of the dry matter of the fibre product.

It is commonly known that by hydrogenation alkene chains can be converted to saturated alkane chains; therefore, the $R_3$ and $R_4$ groups of the alkenyl succinic acid of formula m can be converted by hydrogenation to saturated alkyl groups. The AS acid can be neutralised, as acids in general, by an alkali, such as sodium hydroxide and potassium hydroxide, into a corresponding salt which is water-soluble. The salt solution of AS acid can be used together with AKD dispersion in a similar way as the dispersion of AS acid.

A dispersion can be manufactured from the AS acid in a centralised way in an equipment intended for it, for example, together with AKD, and no paper and cardboard machine-related emulsifying equipment is needed, which is the case when ASA is used. In the dispersion of AS acid, the same dispersion agents, emulsion-stabilising and sizing-intensifying agents can be used as in the dispersion of ASA mentioned above.

It is known that AKD or ASA can be dispersed in water by using the surface-active and stabilising agents described above by a high-pressure homogeniser, such as Rannie, or a rotor-stator-dispergator, such as Ultraturrax. The dispersion technology is commonly known. The same techniques can be used in the dispersion of AS acid. The AKD dispersion and the AS acid dispersion can be dosed in the form of separate formulations which are manufactured in the manner described above, or the dispersions can be mixed to form one dispersion in which the AKD and the AS acid particles are in the form of separate drops. The AS acid can also be mixed with the AKD in advance, and the mixture can be dispersed in water in the manner described above, so that the AKD and the AS acid are in the same dispersion particle. The content of AKD in the dispersion is preferably 0.5–20% by weight. The content of AS acid in the dispersion is preferably 0.2–10% by weight.

In the paper machine, the complete AKD mixture can be dosed into the water circulation either directly or in a prediluted form. ASA which is manufactured in the vicinity of the paper machine is generally made into its final measuring concentration which is normally 0.2–5%. According to the invention, a suitable amount of AKD in the pulp is 0.01–0.4% of the amount of the dry matter of the pulp, and the amount of AS acid is 0.003–0.2% by weight of the amount of the cellulose fibres. The dosage is mainly dependent on the quality and the size degree of the pulp that is to be sized. The amount of the AS acid (or its salt as calculated as acid) is preferably 5–50% by weight of the amount of AKD, and more preferably 10–30% by weight of the amount of AKD.

In the manufacture of paper or cardboard, the chemicals that are conventionally added to the pulp, such as retention aids, optic clarifiers, colouring agents, and anti-foaming agents can be used with the dispersion or the dispersions. The retention aids can include, for example, cationic polymers and starch, and bentonite and silica-based and aluminium-based sols which are used jointly with them.

The invention is illustrated by the following examples.

EXAMPLE 1

An AKD comprising alkyl groups $R_1$ and $R_2$ with an average number of 16 carbon atoms, was dispersed in boiled starch which had been cationised with quaternary nitrogen and the nitrogen content of which was 0.35% by weight, by using a high pressure homogeniser. The content of AKD in the dispersion was 1% and the content of starch was 1.5%.

A terminal (C16/C18) AS acid was similarly dispersed in cationic starch to form a 1% dispersion in the same way as the AKD dispersion. For a control sample, an ASA corresponding to the AS acid was dispersed in cationic starch to form a 1% dispersion in the same way as the AKD dispersion, immediately before making a test sheet.

The dispersions were used to carry out test sizing on hand sheets with a pulp mixture in which the pulp consisted of a pine/birch mixture in a weight ratio of 1:1, and the amount of precipitated calcium carbonate (PCC) was 20% by weight of the dry weight of the fibre. The pH of the pulp was 8.3. The prepared sheets were dried at +60° C. overnight and matured at +105° C. for 10 minutes. The Cobb values were assessed according to the SCAN-P 12:76 instruction. The content of AKD was 1.05 kg/ton, and the amount of AS acid varied between 0.12; 0.26; 0.45; and 1.05 kg/ton. As the control sample, a dispersion of ASA and AKD was used according to the table. The obtained Cobb values are presented in the following.

| Test | AS acid (kg/ton) | ASA (kg/ton) | Cobb 60 ($g/m^2$) |
|---|---|---|---|
| 1 | 0 | 0 | 24.0 |
| 2 | 0.12 | 0 | 23.1 |
| 3 | 0.26 | 0 | 22.3 |
| 4 | 0.45 | 0 | 23.0 |
| 5 | 1.05 | 0 | 27.5 |
| Control sample | 0 | 0.45 | 26.1 |

EXAMPLE 2

AS acid and its Na salt were prepared from commercially available internal ASA, the average length of the alkenyl chain being 11, according to the method described above. The starch-based dispersions of the Na salt (pH 7) of AKD and AS acid and the dispersions of the corresponding ASA were prepared as in Example 1. The Na salt of AS acid was dispersion-dosed in test 2 as mixed with the AKD dispersion, and in test 3 separately in the pulp after adding the AKD. The sheets were prepared as in Example 1. The portion of AKD was 1.05 kg/ton in each test point.

| Test | AS acid as Na salt (kg/ton) | ASA (kg/ton) | Cobb 60 ($g/m^2$) |
|---|---|---|---|
| 1 | 0 | 0 | 24.0 |
| 2 | 0.45 | 0 | 22.8 |
| 3 | 0.45 | 0 | 23.6 |
| 4 (control sample) | 0 | 0.45 | 24.4 |

What is claimed is:

1. A hydrophobising composition for paper or a similar fibre product comprising (1) a ketene dimer, and (2) an alkenyl and/or alkyl succinic acid and/or a salt thereof, wherein the amount of ingredient (2), calculated as the amount of acid, is from 5% to 50% by weight of the amount of ingredient (1).

2. A composition according to claim 1, wherein the alkenyl or alkyl succcinic acid is internal, and the sum of the carbon atoms of its alkenyl or alkyl groups is in the range from 7 to 23.

3. A composition according to claim 1, wherein the alkenyl or alkyl succinic acid is terminal, and the sum of the carbon atoms of its alkenyl or alkyl groups is in the range from 7 to 23.

4. A composition according to claim 1, wherein the amount of ingredient (2), calculated as the amount of acid, is from 10% to 30% by weight of the amount of ingredient (1).

5. A composition according to claim 1, wherein the composition is an aqueous dispersion.

6. A composition according to claim 5, wherein the aqueous dispersion contains a stabilising agent selected from the group: starch, cellulose-based polymers, gelatin, guargum xanthan gum or polyvinyl alcohol.

7. A composition according to claim 6, wherein the stabilizing agent is hydroxy ethyl cellulose, hydroxy propyl cellulose, methyl hydroxy propyl cellulose, ethyl hydroxy propyl cellulose or carboxy methyl cellulose.

8. A composition according to claim 1, further comprising a sizing-intensifying agent selected from the group: cationic split starch, chitosan, polyethylene imine, polyepiamine, polyvinyl amine, polydimethyl diallyl or dicyandiamide compounds or polyacrylamide or polyacrylic acid or salts thereof, or aluminium compounds.

9. A composition according to claim 8, wherein the aluminium compounds if polyaluminium chloride, polyaluminium sulphate, poly aluminium nitrate or alum.

10. A method for hydrophobising paper or a similar fibre product, comprising adding to fibres a composition comprising:

(1) a ketene dimer, and (2) an alkenyl and/or alkyl succinic acid and/or a salt thereof, wherein the amount of ingredient (2), calculated as the amount of acid, is from 5% to 50% by weight of the amount of ingredient (1).

11. A method according to claim 10, wherein the alkenyl or alkyl succinic acid is internal, and the sum of the carbon atoms of its alkenyl or alkyl groups is in the range from 7 to 23.

12. A method according to claim 10, wherein the alkenyl or alkyl succinic acid is terminal, and the sum of the carbon atoms of its alkenyl or alkyl groups is in the range from 7 to 23.

13. A method according to claim 10, wherein the amount of ingredient (2), calculated as the amount of acid, is from 10% to 30% by weight of the amount of ingredient (1).

14. A method according to claim 13, wherein ingredients (1) and (2) are added in the form of an aqueous dispersion.

15. A method according to claim 14 wherein both ingredients (1) and (2) are added in the form of separate aqueous dispersions.

16. A method according to claim 10 wherein ingredients (1) and (2) are added simultaneously.

17. A method according to claim 16 wherein the aqueous dispersion/dispersions contains a stabilising agent selected from the group: starch, cellulose-based polymers, gelatin, guargum, xanthan gum or polyvinyl alcohol.

18. A method according to claim 17, wherein the stabilizing agent is hydroxy ethyl cellulose, hydroxy propyl cellulose, methyl hydroxy propyl cellulose, ethyl hydroxy propyl cellulose or carboxy methyl cellulose.

19. A method according to claim 10, wherein ingredients (1) and (2) are added separately.

20. A method according to claim 10, further comprising adding a sizing-intensifying agent selected from the group: cationic split starch, chitosan, polyethylene imine, polyepiamine, polyvinyl amine, polydimethyl diallyl or dicyandiamide compounds or polyacrylamide or polyacrylic acid or salts thereof, or aluminium compounds, to the fibres.

21. A method according to claim 20, wherein the aluminium compounds if polyaluminium chloride, polyaluminium sulphate, poly aluminium nitrate or alum.

22. A method according to claim 10, wherein the total amount of ingredients (1) and (2), which is added to the fibres, is from 0.01% to 0.6% by weight of the dry matter of the fibre product.

* * * * *